US005775636A

United States Patent [19]

Vig et al.

[11] Patent Number: 5,775,636

[45] Date of Patent: Jul. 7, 1998

[54] GUIDED ARTILLERY PROJECTILE AND METHOD

[75] Inventors: John R. Vig, Colts Neck, N.J.; Steven W. Waugh, Alexandria, Va.

[73] Assignee: The United States of America as represented by the Secretary of the Army, Washington, D.C.

[21] Appl. No.: 723,069

[22] Filed: Sep. 30, 1996

[51] Int. Cl.[6] ..... F42B 10/00; F41G 7/00

[52] U.S. Cl. ..... 244/3.24; 244/3.21; 244/3.23; 244/3.26

[58] Field of Search ..... 244/3.11, 3.21, 244/3.23, 3.24, 3.26; 102/213

[56] References Cited

U.S. PATENT DOCUMENTS

| | | | |
|---|---|---|---|
| 3,711,040 | 1/1973 | Carver | 244/3.21 |
| 4,098,191 | 7/1978 | Bagwell et al. | 102/213 |
| 4,245,559 | 1/1981 | Wakeman et al. | 102/213 |
| 4,512,537 | 4/1985 | Sebestyen et al. | 244/3.21 |
| 4,533,094 | 8/1985 | Geis et al. | 244/3.24 |
| 4,647,761 | 3/1987 | Cojan et al. | 244/3.16 |
| 4,738,411 | 4/1988 | Ahlstrom et al. | 244/3.11 |
| 4,815,682 | 3/1989 | Feldmann et al. | 244/3.24 |
| 4,859,054 | 8/1989 | Harrison | 102/213 |
| 4,951,901 | 8/1990 | Dunne | 244/3.23 |
| 5,261,629 | 11/1993 | Becker et al. | 102/213 |
| 5,366,176 | 11/1994 | Loewy et al. | 244/203 |
| 5,379,968 | 1/1995 | Grosso | 244/3.21 |
| 5,456,179 | 10/1995 | Lamelot | 102/213 |
| 5,467,940 | 11/1995 | Steuer | 244/3.11 |
| 5,647,558 | 7/1997 | Linick | 244/3.11 |

OTHER PUBLICATIONS

Hollis, Michael S.L., "Preliminary Design of a Range Correction Module for an Artillery Schell", Army Research Laboratory Report ARL-MR-298, Mar. 1996.

*Primary Examiner*—Charles T. Jordan
*Assistant Examiner*—Theresa M. Wesson
*Attorney, Agent, or Firm*—Michael Zelenka

[57] ABSTRACT

A guided artillery projectile is provided for use in improving its accuracy while spinning. The projectile includes an artillery shell, a plurality of movable fins, fin actuators for two-dimensional steering, a fin control for the fin actuators, and a guidance unit for the fin control. A method of guiding an artillery projectile is also provided.

7 Claims, 2 Drawing Sheets

FIG. 1
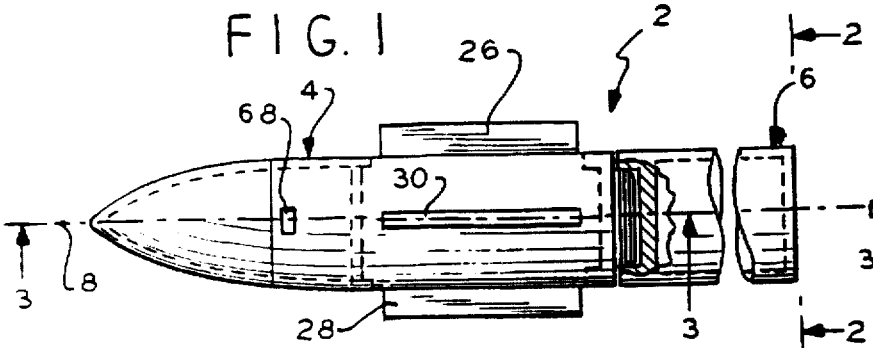
FIG. 2
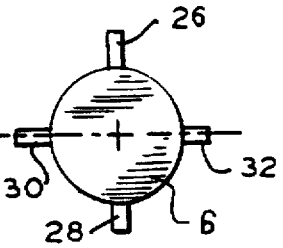
FIG. 3
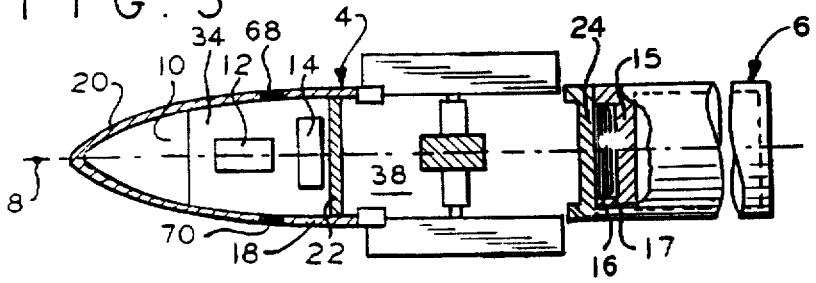
FIG. 7
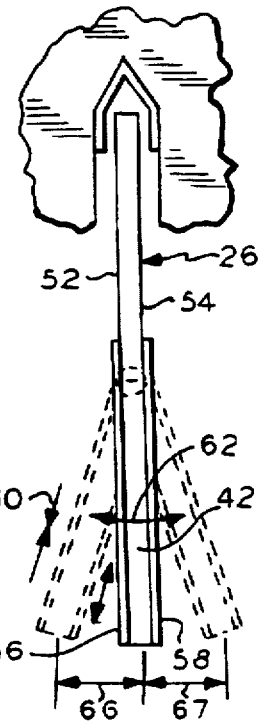
FIG. 4
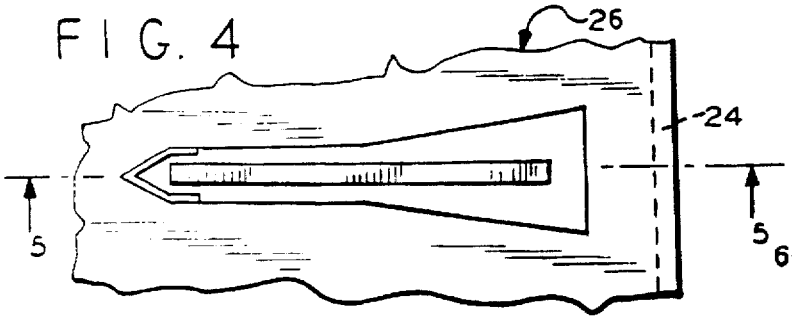
FIG. 5
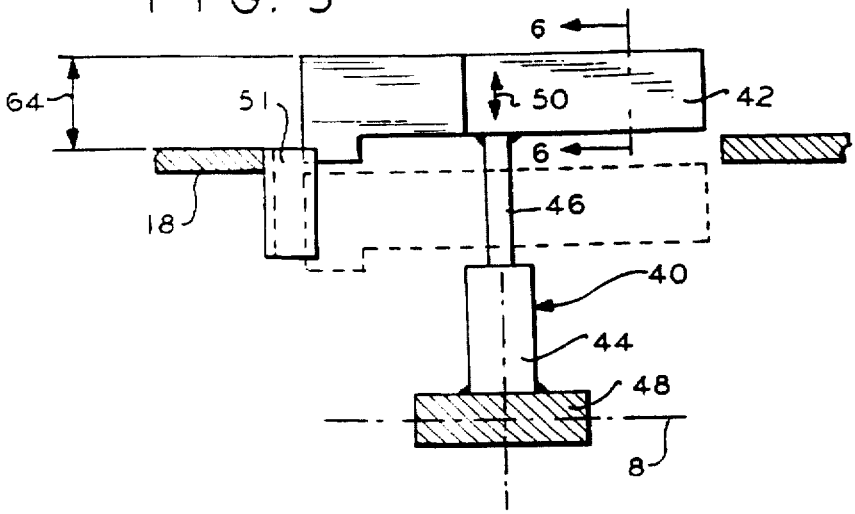
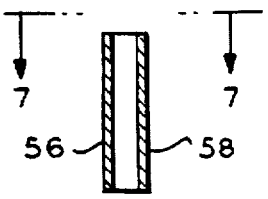
FIG. 6

GUIDED ARTILLERY PROJECTILE AND METHOD

GOVERNMENT INTEREST

The invention described herein may be manufactured, used, imported, sold, and licensed by or for the Government for governmental purposes without the payment to us of any royalty thereon.

FIELD OF THE INVENTION

The invention described herein generally relates to a guided artillery projectile device and method, and in particular the invention relates to a guided artillery projectile device having an artillery shell having a front assembly with relatively movable fins or air-deflectors and a guidance unit disposed inside the artillery shell front assembly for operating the fins/air deflectors while the projectile is in flight and spinning.

BACKGROUND OF THE INVENTION

The prior art artillery projectile is virtually the same as the one used fifty years ago. The prior art artillery projectile is inaccurate, especially at long range. Once the prior art artillery projectile is fired, it is ballistic. Its accuracy is relatively poor because factors such as weather and minor variations in initial conditions of firing can result in large inaccuracies.

One problem with the prior art artillery projectile is that its accuracy is relatively poor.

A second problem is that the projectile typically spins at about 300 revolutions per second upon firing and at about 200 revolutions per second down range, and this makes it difficult to guide the projectile.

With the advances in microelectronics, microelectromechanics, sensor and navigation technologies, it has become possible not only to accurately and continually determine the position of an artillery projectile, but also to control the projectile's trajectory. The Global Positioning System (GPS) has made it possible to rapidly and accurately determine the position of an object anywhere on earth, in any weather, 24 hours a day. As the size and cost of GPS receivers and inertial measurement units (IMU) have declined, it has become more and more feasible to employ GPS and IMUs for guiding projectiles.

Trajectory control methods and devices, with emphasis on a "D-ring correction module," are described in Army Research Laboratory Report ARL-MR-298 by Michael S. L. Hollis, "Preliminary Design of a Range Correction Module for an Artillery Shell," March 1996. The D-ring correction module can provide one-dimensional, i.e., range, correction only. A method that has been proposed for obtaining two-dimensional correction uses a motor to despin the front part of the projectile. This front part contains canards (fins), among other parts, which are used to correct the trajectory of the projectile.

As there are many millions of artillery projectiles in inventory, in the development of guided projectiles, the main emphasis has been on methods that would allow the modification of existing projectiles, rather than on the design of a new type of projectile. That is, the goal has been to replace the fuse of existing projectiles with a device of similar size and shape, the replacement device containing, in addition to the fuse, a GPS receiver and IMU, a trajectory correction mechanism, and a power source.

The present invention provides a new type of trajectory control mechanism which requires no despinning, which utilizes a GPS receiver to guide the projectile toward its target and which is applicable to both existing projectiles and to projectiles of new designs.

SUMMARY OF THE INVENTION

According to the present invention, an artillery projectile is provided. This artillery projectile includes an artillery shell, a plurality of fins mounted on the shell and movable relative thereto, each fin having actuating means for providing two dimensional steering of the projectile during projectile spinning, a control means for controlling the actuating means, and a guidance unit for providing information to the control means.

By using the guidance unit, initial errors introduced into the ballistic trajectory are calculated and corrected for during flight by manipulation of the fins or air deflectors, thus significantly improving overall projectile accuracy.

By using the unique actuators and fins/air deflectors synchronized with the spin of the projectile, spinning of the projectile does not interfere with the guidance.

BRIEF DESCRIPTION OF THE DRAWINGS

The foregoing and other objects, features and advantages will be apparent from the following description of the preferred embodiment of the invention as illustrated in the accompanying drawings.

FIG. 1 is an elevation view of a complete artillery projectile including an embodied fuse unit, according to the invention;

FIG. 2 is a sectional view as taken along the line 2—2 of FIG. 1;

FIG. 3 is a sectional view as taken along the line 3—3 of FIG. 1;

FIG. 4 is an enlarged view of a portion of FIG. 1;

FIG. 5 is a sectional view as taken along the line 5—5 of FIG. 4;

FIG. 6 is a sectional view as taken along the line 6—6 of FIG. 5;

FIG. 7 is a sectional view as taken along the line 7—7 of FIG. 6;

DESCRIPTION OF THE PREFERRED EMBODIMENT

Figure 8:
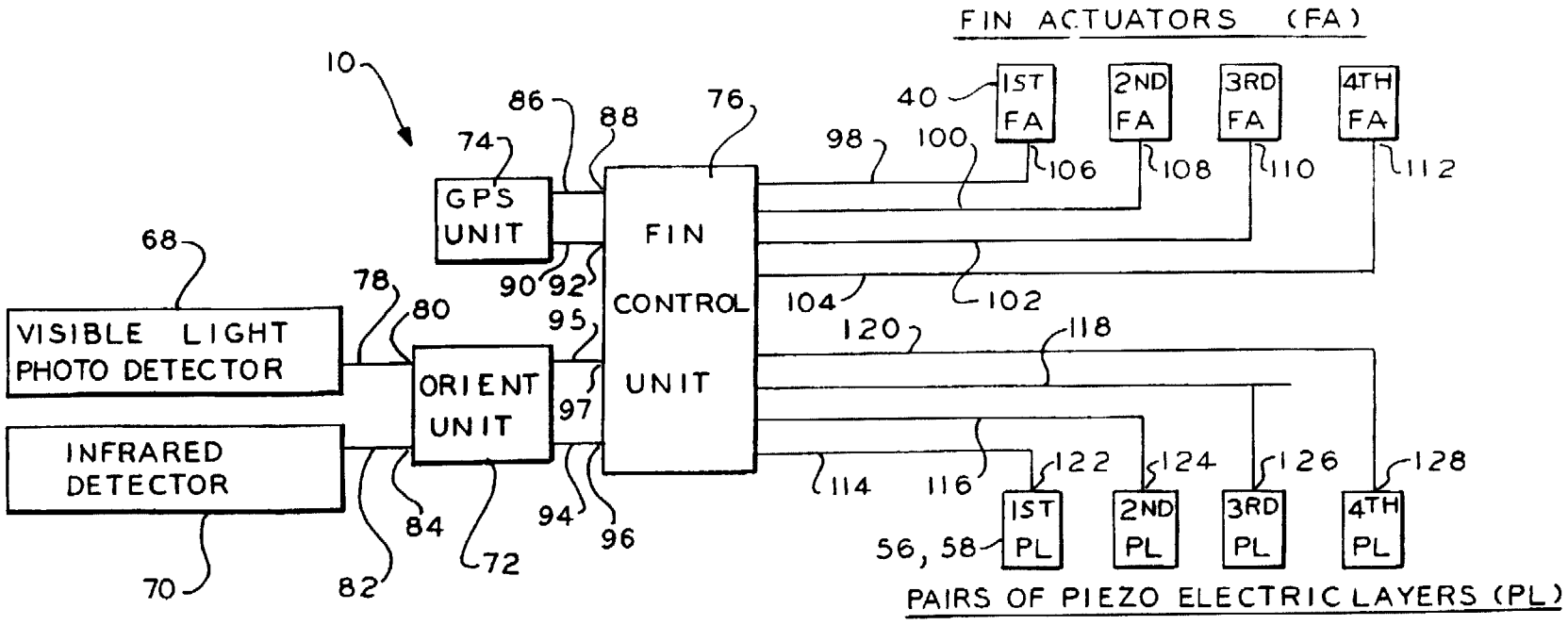
FIG. 8 is a block diagram of a circuit of a guidance unit in FIG. 3.

As shown in FIGS. 1 and 2, a complete artillery projectile 2 is provided. Projectile 2 has a front assembly 4 and a rear assembly 6 which have an axis 8. Front assembly or fuse assembly 4 has an embedded guidance unit or package 10, a fuse unit 12, and a control circuit unit 14. Front assembly 4 also has a threaded projection 16, which is received in a threaded recess 17 in end wall 15 of rear assembly 6. Rear assembly 6 is a standard ordinance shell assembly. Front assembly or fuse device 4 replaces a fuse portion of the standard ordinance shell assembly. Front assembly 4 has a longitudinal, outer profile which fairs into and matches the longitudinal outer profile of rear assembly 6. Fuse unit 12 has a detonator (not shown) which is actuated by an impact force. Alternately, trajectory position or altitude can be used to actuate the detonator, using a signal from guidance unit 10 to fuse unit 12. Also, the guidance unit 10 has means (not shown), which prevent detonation unless projectile 2 lands within a specified pre-programmed area. Guidance unit 10 has a power source (not shown) for supplying power to units 10, 12, and 14. Guidance unit 10 also contains a GPS receiver and antenna (not shown), and may also contain an inertial measurement unit (IMU) and a central processing unit (CPU). The outer surfaces of front assembly 4 and rear assembly 6 are shown in FIGS. 1 and 2 as cylindrical, for ease of illustration. Alternately, the outer surfaces can taper towards the front end.

Front assembly 4 has a peripheral wall or casing 18, which supports fuse unit 12, a front tapered wall portion 20, which supports guidance unit 10, a partition wall 22, which supports unit 14, and a rear wall 24.

Front assembly 4 has a top fin 26, a bottom fin 28, a left fin 30 and a right fin 32, which are air deflectors, and which are radially movable for extension and retraction thereof, and which are bendable for steering projectile 2. Front assembly 4 has a front cavity 34 for units 10, 12, 14, and has a rear space 38 for the fins 26, 28, 30, 32. Cavity 34 may also contain explosive material (not shown).

As shown in FIGS. 4, 5, 6, 7, top fin 26, which is identical in construction to bottom fin 28, left fin 30 and right fin 32, has a top actuator 40 and has a top blade or core 42. Top actuator 40 has a cylinder 44 and a piston 46. Piston 46 is welded or fixedly connected to blade 42. Cylinder 44 is supported on a common support hub 48, which has support spokes or struts (not shown). Actuator 40 is an electromechanical type of actuator. Piston 46 and fin 26 move in a radial direction 50 towards and away from shell 12. Blade 42 is guided by a channel 51. Cylinder 44 is a high speed vibrator, or the like.

Blade 42 has first and second faces 52, 54. Faces 52, 54 have respective pairs of piezoelectric layers 56, 58, which are bonded thereto. Layers 56, 58 are electrically interconnected in order to bend blade 42. Layers 56, 58, expand and contract in opposite lengthwise directions 60 in order to bend blade 42. Blade 42 is displaced in a transverse direction 62 in order to steer projectile 2. Blade 42 during operation has a variable blade projection 64, and has variable transverse displacements or bend distances 66, 67.

As shown in FIGS. 1 and 8, guidance system 10 includes a visible light photodetector 68, and infrared (IR) detector 70, an orientation unit 72, a positioning subsystem (GPS) 74, and a fin control unit 76. Units 68, 70, 72, 74, 76 each has a power supply connection (not shown) and has a ground connection (not shown).

Photodetector 68 has an output conductor 78, which is connected to an input 80 of orientation unit 72. IR detector 70 has an output conductor 82, which is connected to an input 84 of orientation unit 72. Detectors 68 and 70 provide day and night sensing of the horizon.

GPS unit 74 has a first output conductor 86, which is connected to a first input 88 of fin control unit 76. GPS unit 74 also has a second output conductor 90, which is connected to a second input 92 of fin control unit 76.

Orientation unit 72 has an output conductor 94 which is connected to a third input 96 of fin control unit 76; and has a second output 95, connected to input 97.

Fin control unit 76 has respective first and second and third and fourth output conductors 98, 100, 102, 104, which are respectively connected to fin actuators 106, 108, 110, 112. Fin control unit 76 has respective fifth and sixth and seventh and eighth output conductors 114, 116, 118, 120, which are respectively connected to pairs of piezoelectric layers 122, 124, 126, 128.

Conductor 86 provides velocity change signals. Conductor 90 provides direction change signals. Conductor 94 provides orientation signals. Conductor 95 provides spin rate signals.

Using projectile 2, it is not necessary to despin the projectile 2, before using its guidance system 10. The same or better results are obtained by means of the movable fins 26, 28, 30, 32, which protrude from the projectile 10. The motions of fins 26, 28, 30, 32 are synchronized with the spin rate of the projectile 2, such that the fins 26, 28, 30, 32 protrude or project an appropriate distance 64, and for an appropriate duration, always at the orientation required for guiding projectile 2 to its target. The orientation of projectile 2 is determined by the combination of the visible light photodetector 68 and the IR detector 70, for respective use in day and night operations. When the IR detector 70 is an uncooled thermal detector, such as a silicon micromachined bolometer, it may be suitable for use at both day and night times, thus eliminating the need for a separate photodetector. The difference in emissivity between the earth and the sky is sufficient for the determination of the projectile's orientation. The GPS unit 74 is used to decide the direction and velocity changes needed. The detector 68 or 70 determines the projectile's orientation and the outputs from the detectors 68, 70 are used as inputs to the control unit 76, which controls the fins 26, 28, 30, 32. The fins or air deflectors 26, 28, 30, 32 move in and out in synchronism with the spin of projectile 2, and avoid the need to despin the projectile 2.

The method of guiding the artillery projectile 2 includes the steps as indicated hereafter:

provide an artillery projectile 2 having relatively movable fins 26, 28, 30, 32 which are recessed in the projectile 2 during its firing and which project radially outwardly in an in-out movement during spin of the projectile;

control the rate of in-out movement of the fins 26, 28, 30, 32 in synchronism with the rate of the spin of the projectile 2;

control the movable fins 26, 28, 30, 32 for steering of the projectile 2 to a target; and determine the velocity change and direction change for the control of the steering of the projectile 2 to the target.

The advantages of projectile 2 are indicated hereafter.

A) Projectile 2 avoids the problem of poor accuracy.

B) Projectile 2 avoids the need to despin the projectile before using its guidance system.

C) One can use an existing inventory projectile, simply augmented with a new fuse unit.

To minimize the energy required for the in and out movement of the fins, some of the energy required for the outward motion can be recovered during the inward motion.

While the invention has been described in its preferred embodiment, it is to be understood that the words which have been used are words of description rather than limitation and that changes may be made within the purview of the appended claims without departing from the true scope and spirit of the invention in its broader aspects.

For example, instead of fins 26, 28, 30, 32, all piezoelectrical fins or flaps can be used.

As a second example, instead of the GPS positioning subsystem, an inertial measuring subsystem or a doppler subsystem can be used, for providing information about the necessary velocity and direction changes.

As a third example, the invention may be applied not only to artillery projectiles but also to other types of precision guided munitions.

As a fourth example, a hinged flap can be used in place of blade 42.

As a fifth example, the detonator (not shown) of fuse unit 12 can be actuated at a selective altitude instead of by an impact force.

What is claimed is:

1. A projectile comprising:

a shell having an axis;

a plurality of air deflectors mounted on the shell and movable relative thereto;

actuating means connected to the air deflectors for providing steering of the projectile during spinning thereof without the need to despin any portion of the projectile;

control means for controlling the actuating means;

a guidance system including a GPS receiver for providing information to the control means; and a fuse unit for detonation of the projectile upon actuation of the fuse unit and wherein the actuating means includes a plurality of cylinders with pistons respectively connected to the air deflectors for movement of the air deflectors in a radial direction at a rate in synchronism with a spin rate of the projectile; and wherein said air deflectors are fins.

2. The projectile of claim 1, wherein the actuating means includes a plurality of piezoelectric layers respectively connected to the fins for bending of the fins for steering of the projectile.

3. The projectile of claim 1 wherein the fuse unit has a detonator which is actuated at a selective trajectory point by the guidance system.

4. The projectile of claim 1 wherein the guidance system has means to prevent detonation unless the projectile lands within a specified pre-programmed area.

5. A method of guiding a spinning projectile toward a selected target including the steps of:

utilizing a GPS receiver carried in the projectile to determine the position of the projectile relative to the target;

providing a selective shell having bendable, relatively movable fins which project radially outwardly in an in-out movement during the spin of the projectile, said in-out movement occurring at some rate;

controlling the rate of in-out movement of the fins in synchronism with the rate of the spin of the projectile;

controlling the bending of the movable fins for steering the projectile or target;

determining the velocity change, direction change, spin rate and orientation for the control of the steering of the projectile to the target.

6. The method of claim 5, wherein the selective shell is an artillery shell.

7. The method of claim 5, wherein determining the velocity change and direction change and spin rate and orientation includes sensing of the emissivity between the earth and sky for determining spin rate and orientation.

* * * * *